US007635115B2

(12) United States Patent
Lehmann

(10) Patent No.: US 7,635,115 B2
(45) Date of Patent: Dec. 22, 2009

(54) PROTECTIVE COVER FOR FENCE RAIL CAP

(75) Inventor: Walter R. Lehmann, Ponce Inlet, FL (US)

(73) Assignee: Ideal Aluminum Products, LLC, Deland, FL (US)

( * ) Notice: Subject to any disclaimer, the term of this patent is extended or adjusted under 35 U.S.C. 154(b) by 0 days.

(21) Appl. No.: 11/669,632

(22) Filed: Jan. 31, 2007

(65) Prior Publication Data

US 2008/0029747 A1 Feb. 7, 2008

Related U.S. Application Data

(60) Provisional application No. 60/764,204, filed on Feb. 1, 2006.

(51) Int. Cl.
*E04H 17/00* (2006.01)

(52) U.S. Cl. ..... 256/65.12; 256/19; 256/22; 256/59; 256/66

(58) Field of Classification Search ..... 256/19, 256/21, 22, 59, 65.01, 65.02, 65.11, 65.12, 256/66, 68, 69
See application file for complete search history.

(56) References Cited

U.S. PATENT DOCUMENTS 1,376,150 A * 4/1921 Miller ..... 256/21
3,312,029 A * 4/1967 Blum et al. ..... 256/65.02
3,352,541 A * 11/1967 Thom ..... 256/21
5,938,184 A * 8/1999 DeSouza ..... 256/19
6,029,954 A * 2/2000 Murdaca ..... 256/59
6,039,307 A * 3/2000 De Zen ..... 256/19
6,375,166 B1 * 4/2002 Schall et al. ..... 256/59
6,481,696 B1 11/2002 Lion et al.
6,622,991 B2 9/2003 Steffes
6,811,146 B1 * 11/2004 Giralt ..... 256/65.01
6,874,766 B2 * 4/2005 Curatolo ..... 256/59
6,883,786 B2 4/2005 Bebendorf
7,007,363 B2 3/2006 Forbis

FOREIGN PATENT DOCUMENTS

JP 60-187439 * 9/1985 ..... 256/21

* cited by examiner

*Primary Examiner*—Michael P Ferguson
(74) *Attorney, Agent, or Firm*—Mark W. Scott; Beusse Wolter Sanks Mora & Maire, P.A.

(57) ABSTRACT

A fence rail assembly is provided comprising an extruded rail having a lengthwise extending slot for receiving a plurality of fasteners for attaching the rail to a plurality of pickets. The slot is designed with internal flanges adapted for engaging mating flanges on legs of a cover to be placed on the slot. The cover is sized to fit snugly at the slot opening to minimize water and debris intrusion, as well as prevent loosening of the fasteners.

5 Claims, 4 Drawing Sheets

PROTECTIVE COVER FOR FENCE RAIL CAP

SPECIFIC DATA RELATED TO INVENTION

This application claims the benefit of U.S. Provisional Application No. 60/764,204 filed Feb. 1, 2006.

The present invention relates to fences and more particularly to fence rails and protective covers for use with such rails.

BACKGROUND OF THE INVENTION

Picket fences are conventionally constructed with horizontally extending rails that may be attached at each end to a vertically extending post or an edge of a building. Pickets are attached to and supported by the rails with the pickets extending generally vertically to the rails. The pickets may be attached to the rails by means of fasteners, such as screws, extending through a respective one of the rails and into a corresponding one of the pickets. One of the issues that arise with use of such fasteners to attach rail to picket is that the fastener is exposed and generally unsightly. Further, the fastener is subject to corrosion from exposure and may become even more unsightly and, in addition, such corrosion may result in streaks or discoloration at the attachment sight. Accordingly, it would be desirable to provide a method and system for picket to rail attachment that reduces the undesirable appearance of exposed fasteners.

SUMMARY OF THE INVENTION

A method and apparatus for concealing and protecting fasteners used in the attachment of rails to pickets in a picket fence utilizes a rail formed with a lengthwise extending slot having a base for contacting a picket. The slot is sized and configured to receive a snap fit cover that closes the slot and protects the slot from weather while providing an outer surface to hide the slot and any fasteners in the slot. In use, the pickets are attached to the rail by screws or other suitable fasteners that project through the base of the slot and into the associated pickets to securely attach the pickets to the rail. Once the pickets are all attached to the rail, the cover is positioned adjacent the slot and can be pressed into the slot to conceal the fasteners. The slot is preferrably formed with a pair of flanges extending along the lengthwise direction of the rail and located within the slot. One flange is along a top side of the slot and the other flange is along a bottom side of the slot. The cover is formed with a pair of mating flanges so that the cover can be pressed into the slot and the mating flanges interact to fasten the cover in place. The shape and arrangement of the flanges is such that the cover forms a tight fit within the slot to minimize water intrusion.

BRIEF DESCRIPTION OF THE DRAWING

For a better understanding of the present invention, reference may be had to the following detailed description taken in conjunction with the accompanying drawings in which.

DETAILED DESCRIPTION OF THE INVENTION

Figure 1:
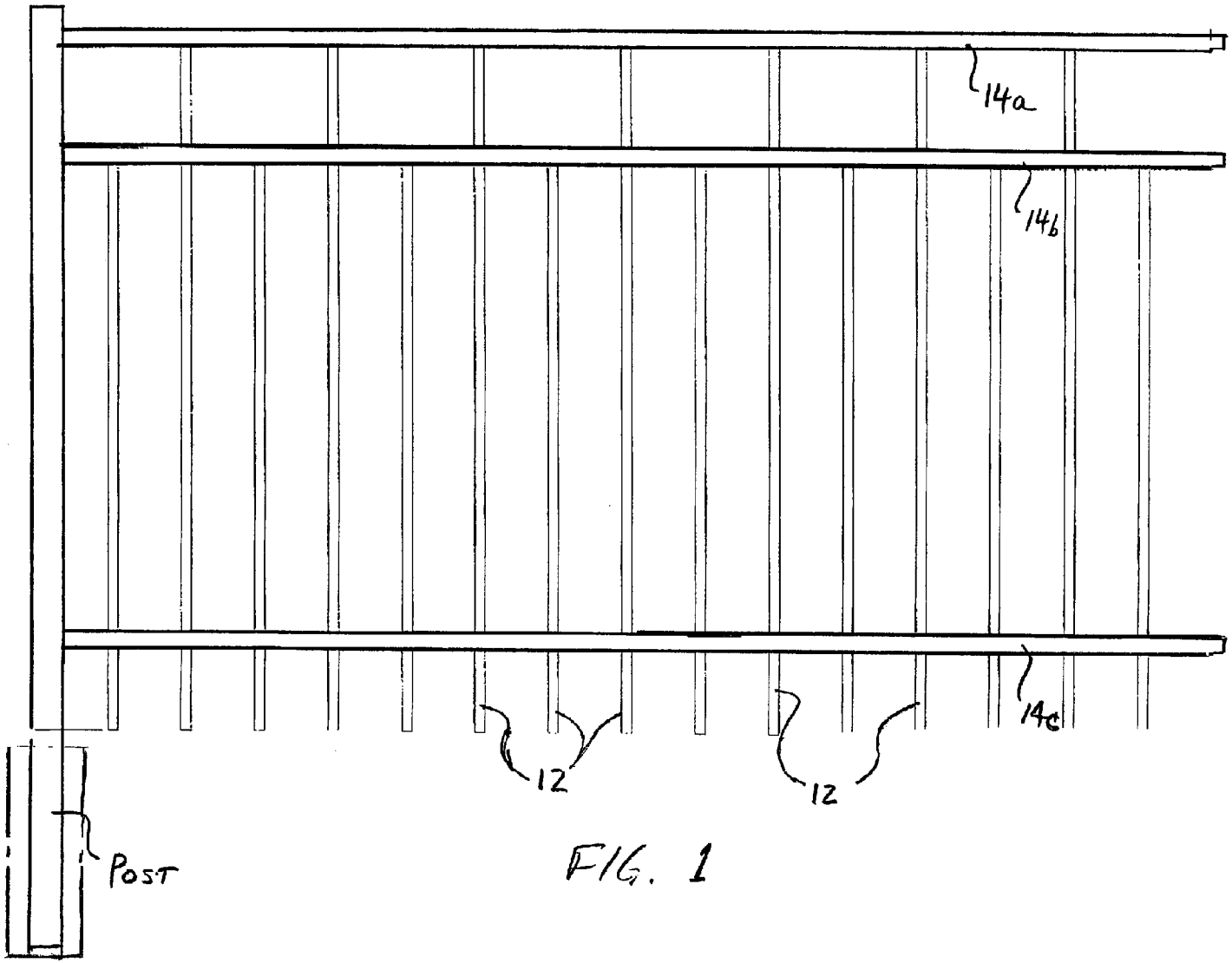
FIG. 1 illustrates one form of conventional picket fence structure with which the present invention may be used.

FIG. 1 is an elevation view of one type of fence with which the present invention may be used. The fence 10 comprises a plurality of vertically extending members or pickets 12 which may have a rectangular cross section and a plurality of rails 14 (inclusive of rails 14A, 14B and 14C) that are used to fix the position of each of the members 12. The rails 14 and members 12 are typically formed of aluminum and attached at each intersection by a screw passing through the rail 14 and threadedly engaging the member 12. One of the issues with this type of fence construction is that the heads of the screws are visible and generally detract from the ornamental effect of the fence. Additionally, the screws provide a site for moisture and other debris to accumulate and can produce corrosion since the screws are made from metal. While most such fences are aluminum, it is also known to construct such fences from various synthetics polymers and to attach the rails and pickets with fasteners such as screws, bolts and rivets.

It should be noted that the top rail 14*a* is adapted to fit over the top end of some pickets or members 12 while the middle rail 14*b* fits over the ends of some members 12 and attaches to the side of other members 12. Rail 14*c* is adapted to attach with side mounting to all of the members 12. Accordingly, different configurations of rails are required to permit such disparate attachment.

Figure 2:
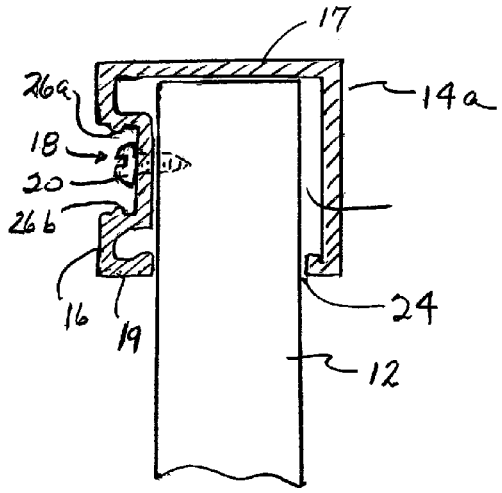
FIG. 2 is a cross-sectional view of one form of rail according to the teaching of the present invention and an associated picket.
Figure 3:
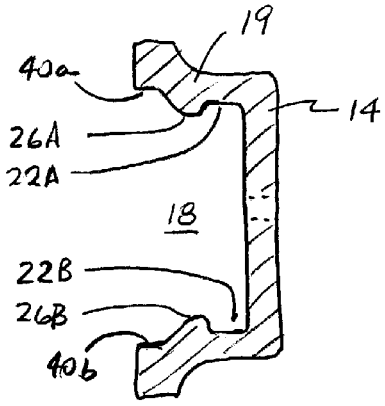
FIG. 3 is a cross-sectional view of another form of rail according to the teaching of the present invention and an associated picket.

FIG. 2 is a cross sectional drawing of one form of rail 14A particularly design as a top rail for use with the members 12 which incorporates a slot 18 for seating attachment screws 20 below the upper or outermost surface 16 of the top rail. The rail 14A has an L-shaped segment 17 that forms, in conjunction with front rail portion 19, a U-shaped opening 24 for snugly receiving the top of the members 12. The overlapping L-shaped segment provides a smooth top rail surface. The screws 20 thread into the top of each member 12 to attach the rail to the member. The slot 18 is defined by a pair of opposite side walls 21A and 21B and a generally flat base 21C. Each side wall 21A, 21B incorporates a lengthwise extending flange 26A, 26B spaced from the base 21C so as to define a respective channel 22A, 22B between each flange and the base. FIG. 3 illustrates a rail 14 without the L-shaped segment 17 that may be used as an intermediate rail below the top rail 14A or may be used in those cases in which it is desired to have the pickets protrude above the top rail.

Figure 4:
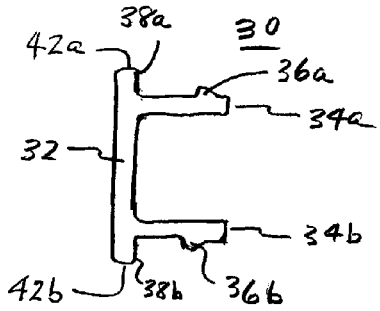
FIG. 4 is a cross-sectional view of a rail insert or cover that can be attached to the rails of FIGS. 2 and 3 to conceal rail-to-picket fasteners.
Figure 2A:
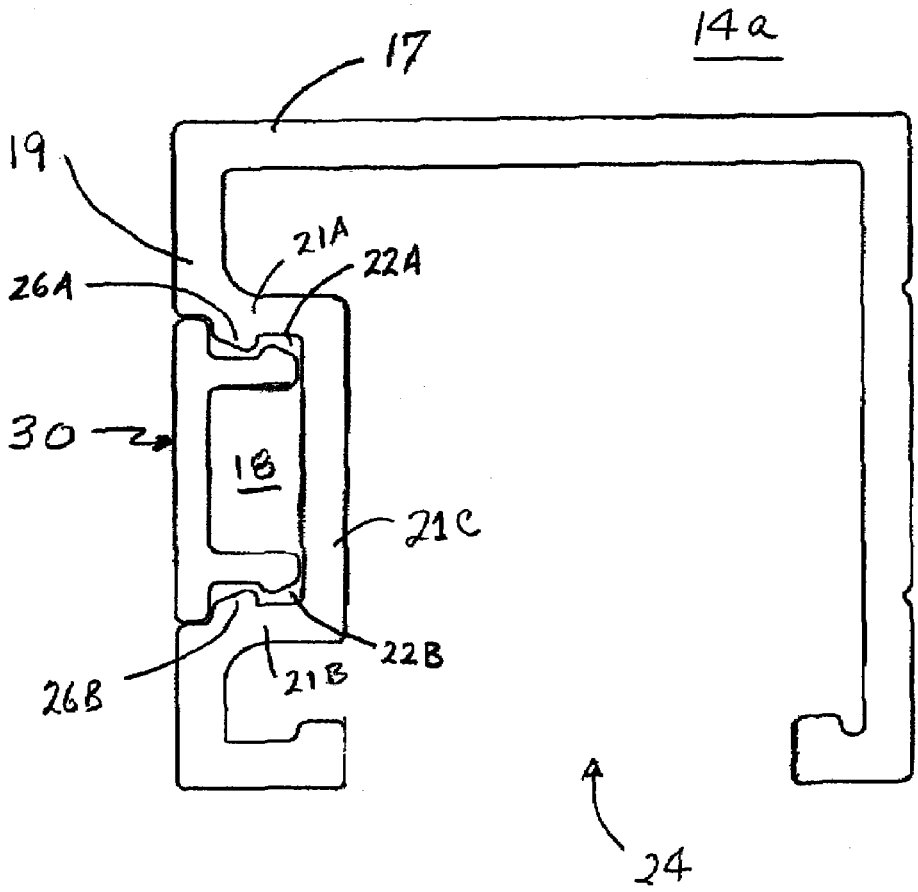
FIG. 2A is an enlarged cross-sectional view of a rail assembly in one form of the present invention.
Figure 5:
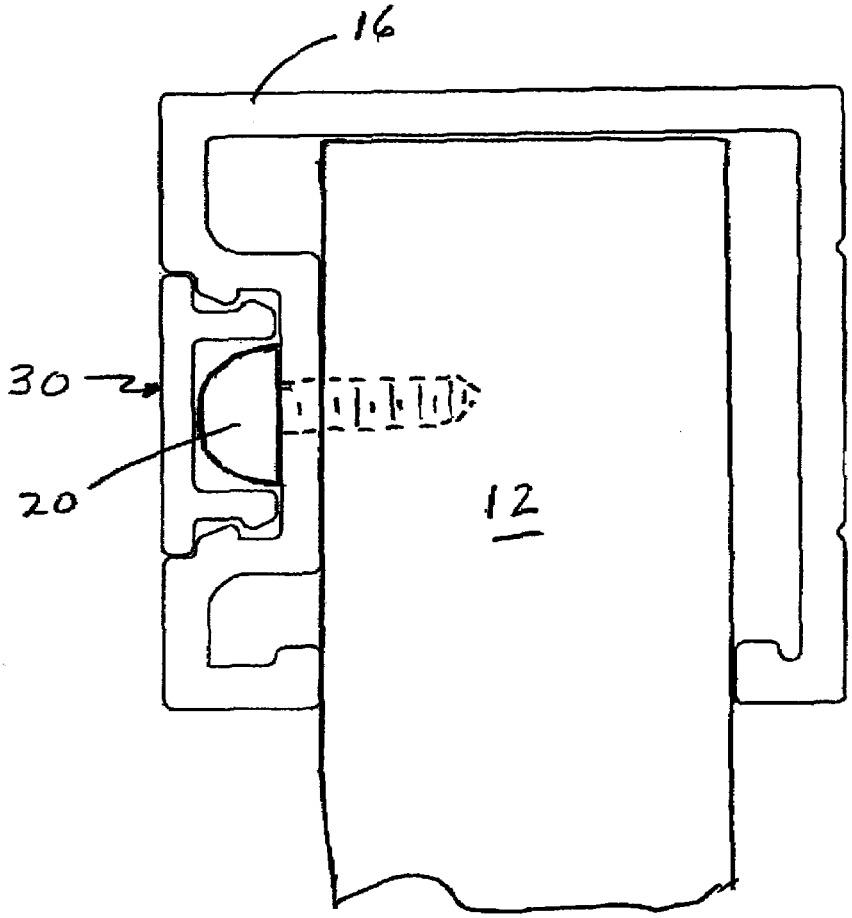
FIG. 5 is a cross-sectional view of a rail and cover in association with a picket.

FIG. 4 is a cross sectional drawing of a cover 30 for use with the rail 14. The cover 30 comprises a formed strip having a flat plate portion 32 and a pair of lengthwise extending leg members 34*a* and 34*b* depending generally perpendicularly from the portion 32. Each of the members 34*a*, 34*b* are formed with outwardly extending flanges 36*a* and 36*b* adjacent their respective ends. The flanges 36*a*, 36*b* are sized to fit into corresponding ones of the channels 22A, 22B of the slot 18 of rails 14. The length of each of the leg members 34 is such as to cause the portion 32 of the cover 30 to seat flush within the slot 18 so as to present a generally continuous flat outer surface of the rail 14 and cover 30 assembly as shown in FIG. 5. The edge surfaces 38*a*, 38*b* of the plate portion 32 abut against the flanges 26*a*, 26*b* to establish a seating depth for the cover while the edges 42*a*, 42*b* seat against the shoulders 40*a*, 40*b* of rail 14 to establish the flush outer appearance.

It will be noted from the drawings that the flanges 26*a*, 26*b* are each shaped with an inwardly sloped forward surface for causing the flanges 36*a*, 36*b* to ride up onto and over the flanges 26*a*, 26*b* as the cover 30 is pressed into slot 18. The legs 34*a*, 34*b* of the cover are designed with sufficient elasticity to allow this deflection of the legs and then to spring back to their original shape as the flanges 36*a*, 36*b* pass by the flanges 26*a*, 26*b*. The shape of the flanges 36*a*, 36*b* is essentially a reverse of the shape of the flanges 26*a*, 26*b* so that the sloped portions of both sets of flanges are effective to cause the legs 34*a*, 34*b* to deflect inwardly. The back edge of each set of flanges 26*a*, 26*b* and 36*a*, 36*b* are formed with a more abrupt surface to establish a locking relationship between the fully inserted cover and the rail.

As best seen in FIG. 5, the relationship in size of the rail 14 and cover 30 is such as to define a snug fit of the cover within the slot 18 and preferrably to establish proximal contact between the cover 30 and the screws 20, particularly if the screws 20 start to loosen. This provides the added benefit of locking the screws into the assembly to prevent loosening while hiding the screws from view. Further, the snug fit between the edges 40 and 42 provides some degree of moisture barrier. It will also be noted that the cover could be extruded as a plastic material while the rail could be formed of aluminum. The cover 30 could be a different color from that of the rail 16 thereby creating an accent strip. The cover 30 may also hide any blemishes on the rail 16 caused by insertion of the screws 20 if overtightened or inserted incorrectly or if the rail is scratched by a slipped screwdriver.

While the embodiments of the rail 14 illustrated in FIGS. 2 and 5 include a U-shaped top for receiving the ends of the pickets 12, it will be recognized that the extruded rail indicated at 14*c* in FIG. 1 would not require a U-shaped top. Accordingly, the rail 14*c* could be extruded in a form such as that shown in FIG. 3 or in some other more eye-appealing configuration. Further, while the slot and cover have been shown in what is considered to be a preferred embodiment, it will be apparent that other shaped slots and covers could be developed within the scope of the present invention. It is intended therefore that the invention not be limited to the specifically disclosed configuration but that it be interpreted within the full spirit and scope of the appended claims.

The invention claimed is:

1. A fence rail assembly comprising:

a horizontally extending extruded rail having a cross-sectional shape having a generally U-shaped portion extending along a length of the rail, the generally U-shaped portion comprising a pair of spaced apart vertical walls extending along a length of a horizontal upper wall of the rail, the spaced apart vertical walls defining a U-shaped opening for receiving upper ends of a plurality of vertically extending pickets, one of the vertical walls of the rail having a lengthwise extending slot for receiving a plurality of fasteners for attaching the rail to vertical sides of the plurality of pickets, the slot being defined by a pair of opposed side walls and a generally flat base, the base being arranged for abutting engagement with the vertical sides of the pickets, each side wall having a lengthwise extending flange spaced from the base so as to define a respective channel between each flange and the base; and an extruded cover comprising an outer plate extending along a length of the slot for concealing the fasteners and a pair of lengthwise extending legs depending from one surface of the plate, the legs each terminating in an outwardly projecting flange and the legs being oriented on the plate such that pressing of the legs into the slot in the rail will cause the flanges on the legs to pass over the flanges on the side walls and be captured in the channels when the cover is fully engaged in the slot to thereby retain the cover on the rail;

wherein the flanges on the side walls are formed with an inwardly tapered surface for causing the legs of the cover to be deflected towards each other as the legs are inserted in the slot, the legs having sufficient elasticity to return to a non-deflected position as the flanges on the legs pass over the flanges on the side walls.

2. The fence rail assembly of claim 1 wherein the surface of the cover opposite the surface to which the legs are attached is shaped to create a generally continuous surface of the rail.

3. The fence rail assembly of claim 1 wherein the U-shaped portion is formed with one leg of the U-shaped portion being a continuation of the rail.

4. The fence rail assembly of claim 2 wherein the rail is extruded aluminum.

5. A fence rail assembly comprising:

a horizontally extending extruded rail having a cross-sectional shape having a generally U-shaped portion extending along a length of the rail, the generally U-shaped portion comprising a pair of spaced apart vertical walls extending along a length of a horizontal upper wall of the rail, the spaced apart vertical walls defining a U-shaped opening for receiving upper ends of a plurality of vertically extending pickets, one of the vertical walls of the rail having a lengthwise extending slot for receiving a plurality of fasteners for attaching the rail to vertical sides of the plurality of pickets, the slot being defined by a pair of opposite side walls and a generally flat base, the base being arranged for abutting engagement with the vertical sides of the pickets, each side wall having a lengthwise extending flange spaced from the base so as to define a respective channel between each flange and the base; and an extruded cover comprising an outer plate extending along a length of the slot for concealing the fasteners and a pair of lengthwise extending legs depending from one surface of the plate, the legs each terminating in an outwardly projecting flange and the legs being oriented on the plate such that pressing of the legs into the slot in the rail will cause the flanges on the legs to pass over the flanges on the side walls and be captured in the channels when the cover is fully engaged in the slot to thereby retain the cover on the rail;

wherein the pair of lengthwise extending legs depend normal from the one surface of the plate along an entire length of the legs, and wherein the legs include a flattened distal end edge that abuts a surface of the base when the cover is fully engaged in the slot to thereby retain the cover on the rail.

* * * * *